US006067670A

United States Patent [19]

Eddy et al.

[11] Patent Number: 6,067,670

[45] Date of Patent: May 30, 2000

[54] BATH AID PROVIDING FAUCET PROTECTION

[76] Inventors: Colleen D. Eddy, 303 Linden St., Manchester, N.H. 03104; Lawrence A. Hinkey, 22 Grove Ave., Glens Falls, N.Y. 12801

[21] Appl. No.: 09/208,568

[22] Filed: Dec. 9, 1998

[51] Int. Cl.[7] ..... A47K 3/024

[52] U.S. Cl. ..... 4/575.1; 4/571.1; 4/580

[58] Field of Search ..... 4/575.1, 573.1, 4/571.1, 559, 580, 579, DIG. 18

[56] References Cited

U.S. PATENT DOCUMENTS

| | | | |
|---|---|---|---|
| 2,853,714 | 9/1958 | Darmstadt | 4/580 |
| 2,992,435 | 7/1961 | De Rosa et al. | 4/575.1 |
| 3,199,121 | 8/1965 | Greto | 4/DIG. 18 |
| 4,574,406 | 3/1986 | Sutton et al. | 4/571.1 |

FOREIGN PATENT DOCUMENTS

| | | | |
|---|---|---|---|
| 1260152 | 3/1961 | France | 4/183 |
| 3134256 | 3/1983 | Germany | 4/580 |

*Primary Examiner*—David J. Walczak
*Attorney, Agent, or Firm*—Davis and Bujold

[57] ABSTRACT

A bath aid for use with a bathtub. The bath aid comprises an elongate body having a top portion and a short leg which together with the body define a cavity for accommodating at least a water spout and preferably the water control knob or knobs of a bathtub. The bath aid is provided with at least one and preferably a pair of opposed attachment devices for securely attaching the bath aid within a bathtub such that the faucet and the control knobs of the bathtub are accommodated within the cavity defined by the bath aid to minimize the possibility of injury to either an adult or a child user. A front surface of the bath aid is contoured to provide comfort to a user while using the bath aid in a bathtub. The bath aid can be provided with a plurality of reinforcement ribs and/or spaces to facilitate use of the bath aid.

20 Claims, 5 Drawing Sheets

BATH AID PROVIDING FAUCET PROTECTION

The present invention relates to a contoured protection device for use in a bathtub to protect a bathing child or adult from being injured by the water spout or the water flow control knob or knobs of a bathtub and, at the same time, also to provide a back rest for an individual while bathing.

BACKGROUND OF THE INVENTION

A variety of bathtub protection devices are currently known in the prior art. For example, there are inflatable as well as padded devices which surround or encase just the water spout of a bathtub to protect a user of the bathtub from banging his or her head, arm or some other body part while bathing or when entering into or exiting from the bathtub. However, such protection devices do not fully protect the user from bodily injury from the water spout and also do not facilitate comfortable use of the bathtub by a child and an adult alike. In addition, such protection devices are not designed to cover the water flow control knob or knobs of a bathtub and thus a user still may be injured from banging his or her head, arm or some other body part on the water flow control knob or knobs while bathing or when entering into or exiting from the bathtub.

SUMMARY OF THE INVENTION

Wherefore, it is an object of the present invention is to provide a bath aid which overcomes the aforementioned problems and drawbacks associated with the prior art bathtub protection devices.

Another object of the invention is to provide a bath aid which provides protection from both the water spout and the water control knob or knobs of a bathtub as well as providing comfort to a bather while using the bathtub.

A further object of the invention is to provide a bath aid which is relatively inexpensive to manufacture and install, while affording safety and comfort to a user while bathing.

Still another object of the invention is to a provide a bath aid in which the inclination of the bath aid, relative to the bathtub, can be adjusted to provide desired comfort during bathing.

Yet another object of the invention is to provide a bath aid which is relatively easy to install in the bathtub and is also relatively easy to remove from the bathtub following use.

A still further object of the invention is to provide a bath aid which is relatively soft and flexible, to prevent or minimize injury to a bather during use, and is also resistant to rust and corrosion.

The present invention relates to a bath aid for use with a bathtub, the bath aid comprising: an elongate body having a top portion and a bottom portion and having a first surface for accommodating a back of a user; the bath aid defining a cavity, on a second opposed surface thereof, for accommodating at least a water spout of a bathtub; and the bath aid having a first attachment device for releasably attaching the bath aid to a desired bathtub surface at a desired angle of inclination relative to a bathtub.

The present invention also relates to a method of using a bath aid within a bathtub to cover at least a water spout of a bathtub, the method comprising the steps of: providing an elongate body with a top portion and an opposed bottom portion, and forming the elongate body with a first surface for accommodating a back of a user during use of the bath aid; defining a cavity, on a second opposed surface of the bath aid, for accommodating at least a water spout of a bathtub; and providing the bath aid with at least a first attachment device for releasably attaching the bath aid to a desired bathtub surface at a desired angle of inclination relative to a bathtub.

BRIEF DESCRIPTION OF THE DRAWINGS

The invention will now be described, by way of example, with reference to the accompanying drawings in which.

DESCRIPTION OF THE PREFERRED EMBODIMENT

Figure 1:
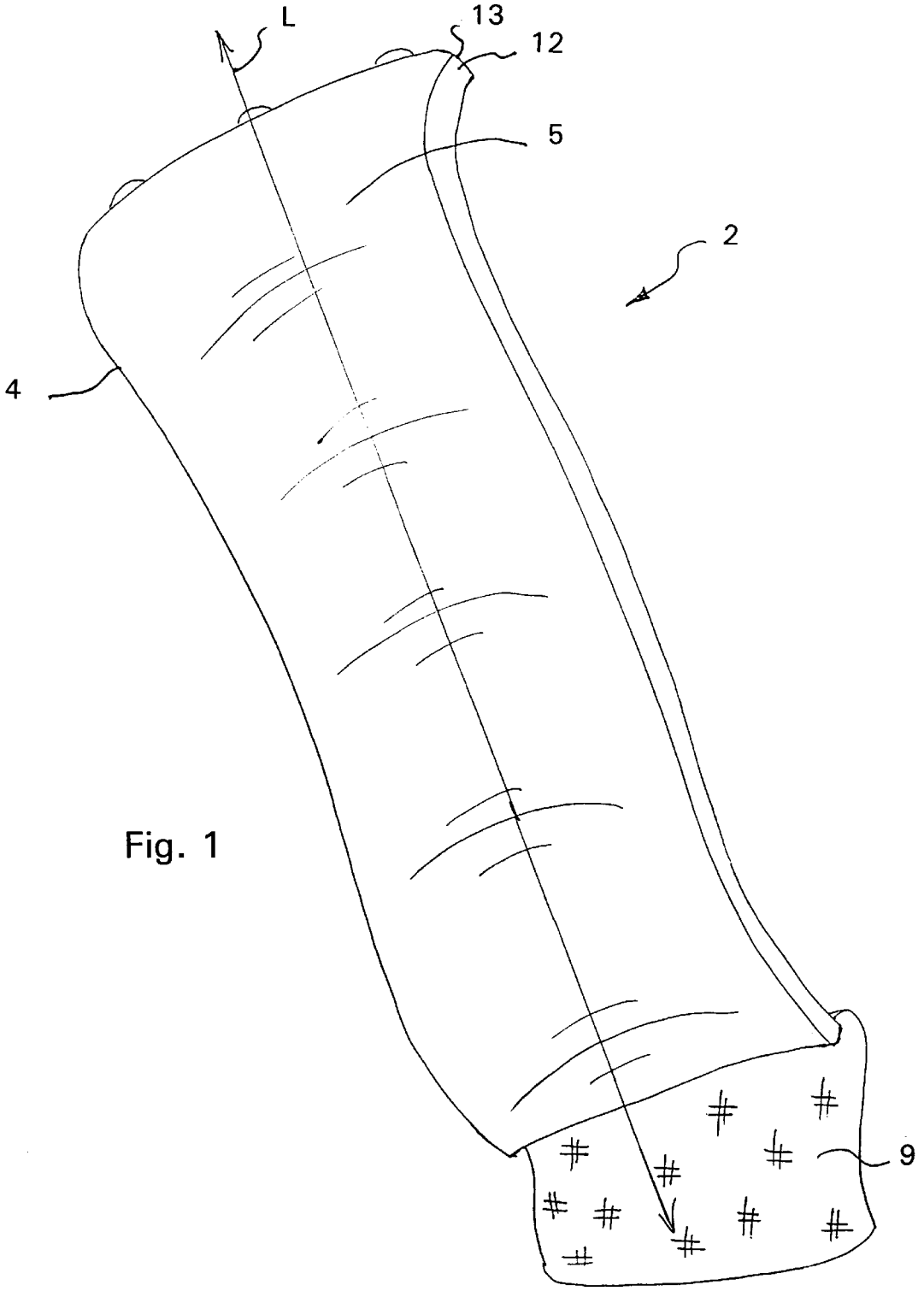
FIG. 1 is a diagrammatic perspective front view of the bath aid according to the present invention.
Figure 2:
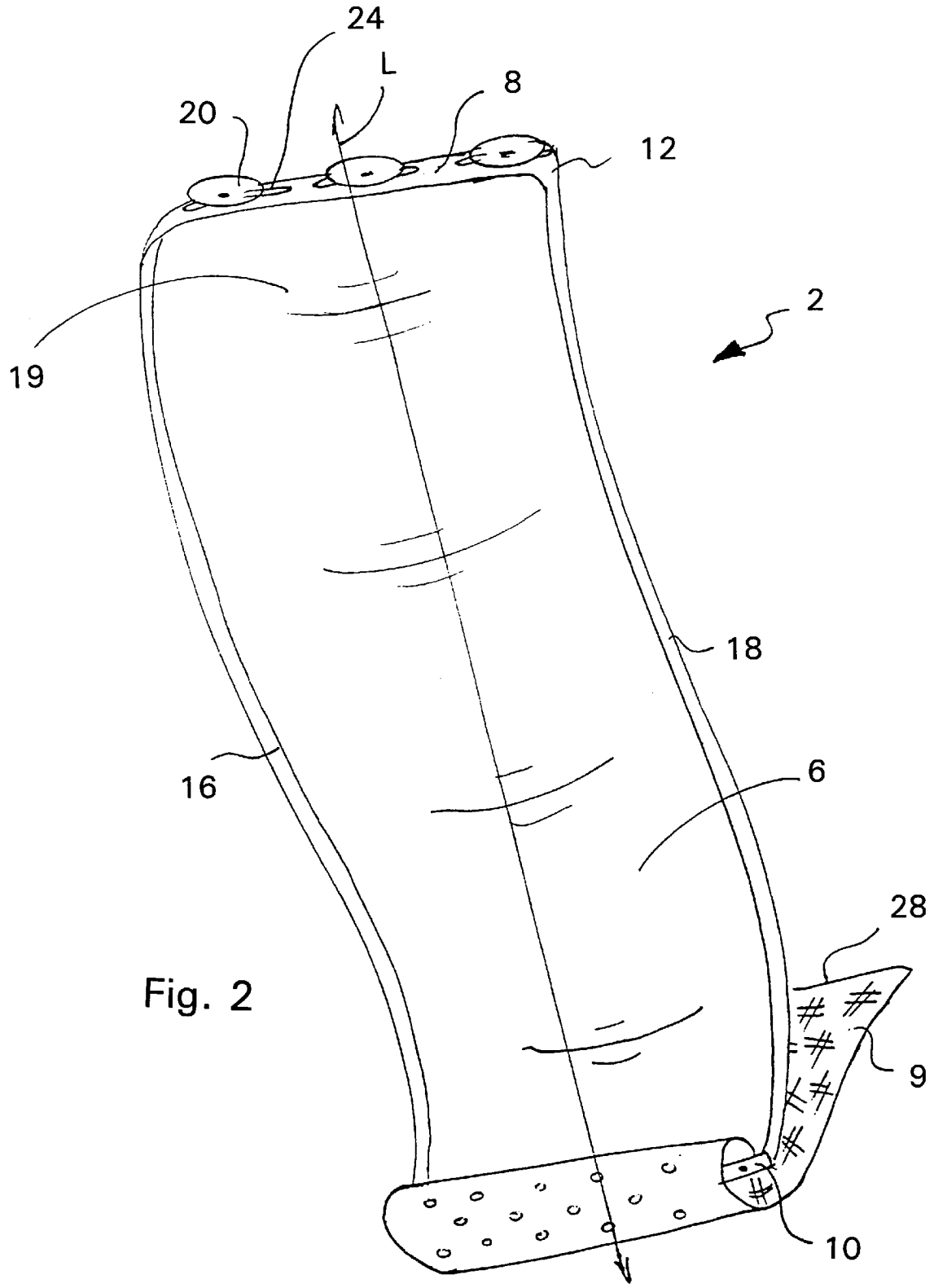
FIG. 2 is a diagrammatic perspective rear view of the bath aid of FIG. 1.

Turning now to FIGS. 1 and 2, a detailed description concerning the present invention will now be provided. As can be seen in these figures, an elongate bath aid 2, according to the present invention, comprises a contoured elongate body 4 which has a front surface 5 which is shaped or contoured, e.g. has a curved or arched transverse profile, to readily accommodate the back of an adult user and also preferably to the back of a child user.

A top portion of the body 4 is provided with a short leg 12 which is bent and extends at an angle of approximately 60° to 90°, preferably at an angle of about 70°, relative to a longitudinal axis L defined by the body 4. A remote free end 13 of the short leg 12 defines an elongate top portion or edge 8 of the body 4 while a bottom end of the body 4 defines an elongate bottom portion or edge 10. The remote free end 13 of the short leg 12 supports, along the elongate top edge 8, at least one and preferably a plurality of attachment devices for releasably attaching or securing the remote free end 13 of the short leg 12 of the bath aid 2 to a desired bathroom wall or surface, e.g. a bathtub tile surface, a bathtub fiberglass or cast iron wall, etc. The attachment device or devices can be, for example, a plurality of adjustably spaced suction cups or any other conventional, well known releasable attachment devices for facilitating secure attachment of the elongate top edge 8 of the bath aid 2 to the desired surface as well as releasing such attachment from the desired surface when use of the bath aid 2 is no longer required or desired.

The bath aid 2 has a pair of opposed side walls 16, 18 which extend along the length of the body 4 from adjacent the elongate top edge 8 to adjacent the elongate bottom edge 10. The two opposed side walls 16, 18, the rear surface 6 of the body 4 and the short leg 12 all define a cavity 19 which provides an adequate space or recess for readily accommodating at least the water spout of a faucet and preferably also accommodating both the hot water and the cold water control knobs or the combined hot/cold water control knob for the water spout.

In a preferred form of the invention, a plurality of suction cups 20, e.g. three suction cups 20, are carried by and equally spaced along the elongate top edge 8. Each one of the suction cups 20 is adjustably supported along the top edge 8 of the remote free end 13 to desired position so that each suction cup 20 can achieve a secured attachment to a desired area of a wall or a surface. To facilitate such adjustment, either a continuous slot or three sequentially arranged and aligned elongate slots 24, each elongate slot having a length of about ½ inches to about 5 inches or so, and more preferably a length of about 1 inch to about 3 inches or so, can be provided along the elongate top edge 8 and each suction cup 20 can be securely fastened or tightened to a respective one of the elongate slots 24, via a conventional nut and bolt arrangement (only diagrammatically shown in the drawings), to facilitate proper positioning and attachment of each suction cup 20 to a desired area of a wall or a surface. As such adjustment feature of the suctions cups is conventional and well known in the art, a further detailed description concerning the same in not provided.

The bottom edge 10 of the bath aid 2 is also provided with a securing device, e.g. one or more suction cups 11 (see FIG. 4), an elongate strip of a rubber, a rectangular piece of a rubber material 9, or some other resilient slip resistance gripping component to facilitate positioning of the elongate bottom edge 10 of the bath aid 2 within a bathtub, without scratching or permanently marking the bathtub, and maintaining the elongate bottom edge 10 of the bath aid 2 at the installed position until subsequent removal of the bath aid 2 by the user is desired at the end of a user session. If a rectangular piece of a rubber material 9 is utilized, one elongate edge of the rubber material 9 is secured to the elongate bottom edge 10 of the bath aid 2 in a conventional manner, e.g. by glue, etc., while the opposed free end 28 of the rubber material 9 extends toward an opposed end of the bathtub 32 (see FIG. 3). The user can stand or sit on the free end 28 of the rubber material 9 and the rubber material 9 also provides a non-slip surface to facilitate a user entering into or exiting from the bathtub. As the feature of securing the rubber material 9 for the lower edge 10 of the bath aid 2 is conventional and well known in the art, a further detailed description concerning the same is not provided.

It is to be appreciated that the rectangular piece of rubber material 9 is very useful in facilitating secure positioning of the elongate bottom edge 10 of the bath aid 2 to a top surface of a desired bathtub 32. Such secure positioning is achieved once a user sits on top of the rubber material 9 and compresses the rubber material onto the top surface of the bathtub 32. As the rectangular piece of rubber material 9 is secured to the elongate bottom edge 10 of the bath aid 2, the rubber material 9 prevents the elongate bottom edge 10 of the bath aid 2 from being moved rearward, i.e. toward the faucet, and thus help facilitates maintaining the bath aid 2 in its originally installed position. Accordingly, by the presently disclosed arrangement, the rubber material is very useful in preventing the elongate bottom edge 10 of the bath aid 2 from sliding, being move or otherwise disturbed from its installed position.

Figure 3:
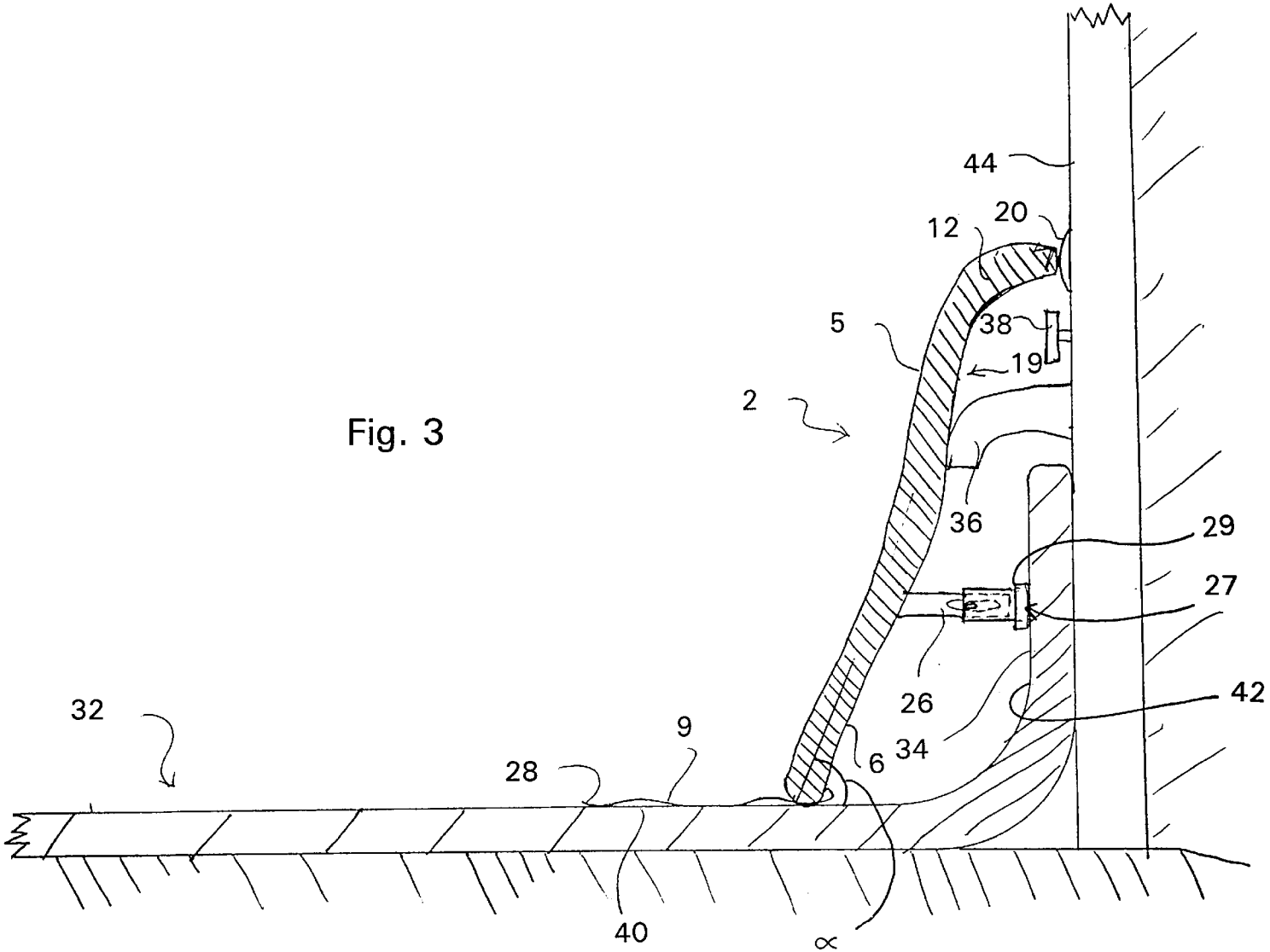
FIG. 3 is a diagrammatic cross-sectional view showing installation of the bath aid of FIG. 2 within a bathtub.
Figure 4:
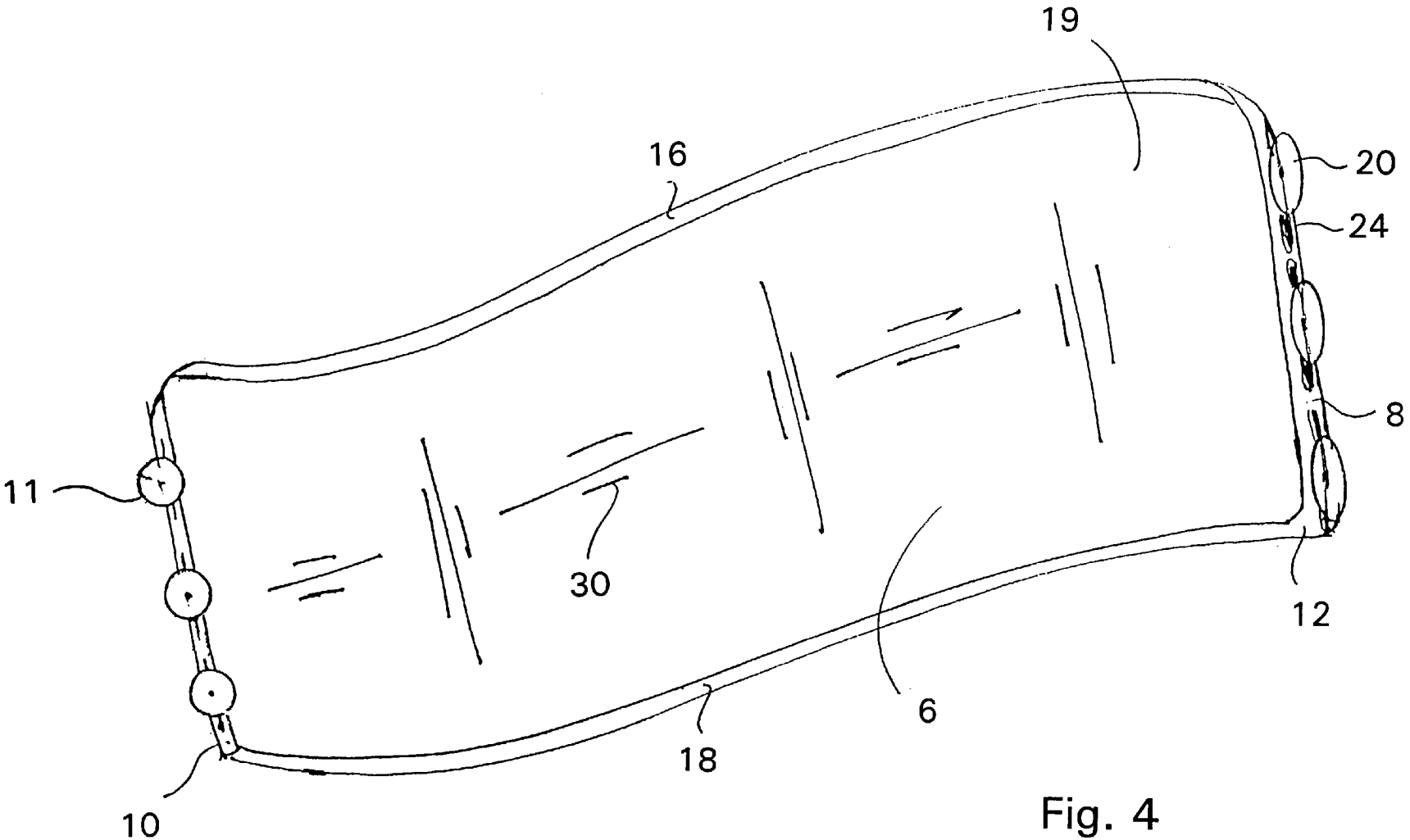
FIG. 4 is a diagrammatic perspective front view of a second embodiment of the bath aid according to the present invention.

According to a further alternative of the present invention, one or more reinforcement ribs 30 are provided along a rear surface 6 of the bath aid 2, e.g. the reinforcement ribs 30 may extend either parallel to or transverse to the longitudinal axis L (see FIG. 4). Each one of the reinforcement ribs 30 is preferably integrally formed or permanently attached to the rear surface 6 of the bath aid 2 and projects substantially perpendicular thereto but can be formed in any manner to provide necessary reinforcement support to the body 4. In addition, as shown in FIG. 3, one or more spacers 26 may be carried by the rear surface 6 of the bath aid 2. The spacers 26 extend generally perpendicular from the rear surface 6 of the bath aid 2 for a distance of about 3 inches to about 18 inches or so, and more preferably a distance of about 6 inches to about 12 inches so that, during use of the bath aid 2, a remote end of each one of each one of the spacers 26 rests against the inwardly facing surface 34 of a bathtub 32 and provides additional support for an intermediate area of the bath aid 2. The free remote end 27 of each one of the spacers 26 preferably has a rubber cap member 29 or some other component which facilitates contact with adjacent surface of the bathtub 32 without scratching or permanently marking the bathtub 32. The spacers 26 preferably have an adjustable length, e.g. a pair of mating members which are movable relative to one another, and as such adjustability feature is well known in the art, a further detail discussion concerning the same is not provided.

Preferably the bath aid 2, according to the present invention, has a longitudinal length of between about 2 feet to about 4 feet, and more preferably a length of between about 2½ feet to about 3½ feet, and a width of between about 10 inches to about 24 inches, and more preferably a width of between about 12 inches to about 18 inches. The short leg 12 preferably has a length of between about 2 inches to about 6 inches, and more preferably a length of between about 3 inches to about 5 inches.

Preferably, the bath aid 2 is manufactured from a light weight, but durable, plastic material, such as polyethylene. KEVLAR®, or from fiberglass or some other known and conventional material which is resistant to rust, yet strong, durable and light weight.

It is to be appreciated that the present invention defines a cavity 19, formed on the rear surface of the bath aid 2, which is useful in enclosing and covering both the water spigot of a faucet 36 as well as the water control knob or knobs 38 of a bathtub faucet, during use, to prevent easy access by an infant or children, to minimize the possibility of the water control knob or knobs 38 of a bathtub faucet 36 injuring a bather or bathers while bathing, and also to provide a back rest to facilitate a leisurely bath by a bather.

As can be seen in FIG. 3, when use of the bath aid 2, according to the present invention, is desired, the bath aid 2 is first placed in a bathtub 32 at a location adjacent the water spigot 36 and water control knob or knobs 38. Next, the attachment device or rubber material 9, supported by the elongate bottom edge 10 of the bath aid 2, is brought into contact with a base 40 of the bathtub 32 such that the elongate bottom edge 10 of the bath aid 2 is sufficiently spaced from end wall 42 of the bathtub, e.g. the bottom edge 10 of the bath aid 2 is spaced a distance of about 3 inches to 18 inches or so from the end wall 42 of the bathtub 32. Such positioning of the bath aid 2 generally locates the attachment device or suction cups 20, carried by the free end of the short leg 12, at a position above the water spigot 36 and also preferably above the water control knob or knobs 38 of the bathtub 32 such that at least the water spigot 36, and also preferably the water control knob or knobs 38, are accommodated within the cavity 19. Once the bath aid 2 is so positioned, as can be seen in FIG. 3, the suction cups 20 carried by the short leg 12 are engaged with the wall 44 supporting the water spigot 36 and/or the water control knob or knobs 38 of the bathtub to securely attach the bath aid 2 at a desired position. If necessary, one or more of the suction cups 20, carried by the short leg 12, can be adjusted along their respective elongate slots 24, to ensure proper secure positioning and engagement with the wall 44 supporting the water spigot 36. If the installed location of the bath aid 2, according to the present invention, is not properly positioned to provide the bath aid 2 with a desired angle of inclination , then the suction cups 20, carried by the short leg 12, can be removed from their engagement with the wall 44 and the elongate bottom edge 10 of the bath aid 2 can be repositioned, i.e. either closer or further away from the end wall 42 of the bath tub 32, so as to achieve the desired inclination angle of the bath aid 2 while still maintaining coverage of at least the water spigot 36 and/or preferably also the water control knob or knobs 38 of the bath tub 32 by the cavity 19 of the bath aid 2.

It is to be appreciated that the bath aid 2 can be made of any desired color and/or carry any desired design or emblem to improve the exterior appearance of the bath aid. In addition, one or more children's games, which are conventional and well known in the art, can be attached to or permanently secured to the bath aid to increase its utility and usefulness in the bathtub.

Figure 5:
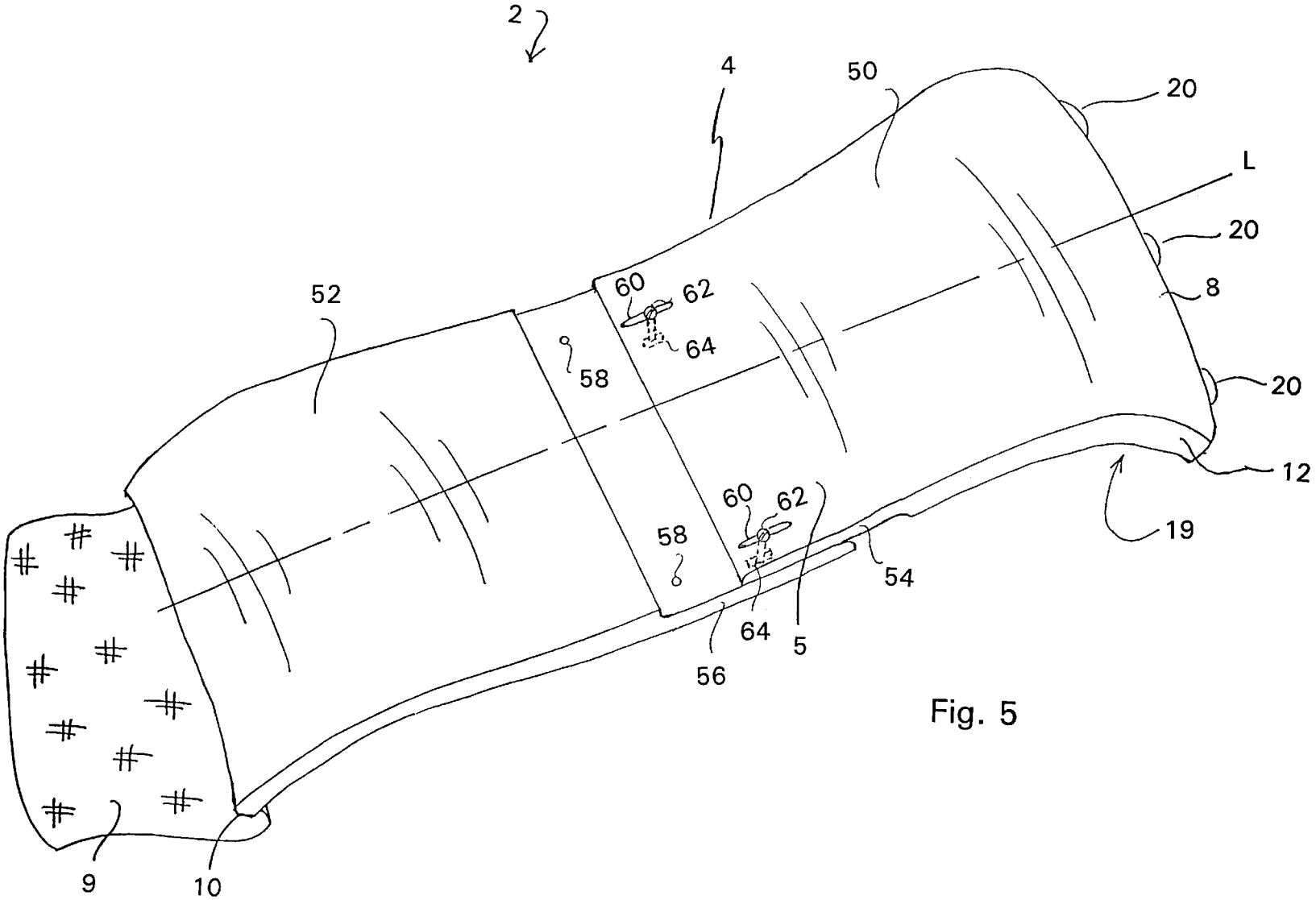
FIG. 5 is a partial diagrammatic cross-sectional view showing a second embodiment of the bath aid according to the present invention.

With respect to FIG. 5, a brief description concerning a second embodiment of the bath aid 2, according to the present invention, will now be provided. As the location of the water spigot 36 and/or control knob or knobs 38 in various households can be located at various heights relative to the base 40 of the bathtub 32, it may be desirable, in some applications, to have an adjustable length bath aid 2. To facilitate such adjustment length, the bath aid 2, according to the present invention, is formed from two sections, i.e. a top section 50 of the body and a bottom section 52 of the body. A portion 54, 56 of each of the top and bottom sections 50, 52 overlap one another and are slidable relative to one another. To facilitate such sliding adjustment, one of the overlap portions of the top or bottom sections 50 or 52 is provided with at least one and preferably a plurality of apertures 58 while the opposed overlapped section 52 or 50 is provided with an elongate slot 60, extending along the longitudinal axis L of the bath aid 2, to facilitate relative sliding movement between the top and bottom sections 50, 52. A conventional bolt 62 is passed through the aperture(s) 58 and the mating slot(s) 60 and is connected to a conventional nut 64, e.g. a wing nut. When the bolt and nut arrangement 62, 64 is in a loosened condition, this allows relative movement between the top and bottom sections 50, 52, and when the bolt and nut arrangement 62, 64 is in a tightened conditioned, this prevents relative movement between the top and bottom sections 50, 52. It is to be appreciated that the nut 64 is preferably utilized on the rear surface of the bath aid 2, e.g. the nut can be either permanently secured or integrally molded as part of the bottom section 52, while the head of the bolt 62 is preferably utilized on the front surface of the bath aid 2 and is rounded or has some other sleek profile to minimize the interference of the bolt head on the back of a user during use of the bath aid 2. As the above described adjustment feature is conventional and well known in the art, a further detailed description concerning the same is not provided. It is to be appreciate that other conventional and well known mechanisms, which allow relative longitudinal movement between the top and bottom sections, could also be employed and are considered in the spirit and scope of the present invention.

It is to be appreciated that the bath aid 2 can be manufactured from two separate components, e.g. a top section and a bottom section, that are hinged together, in a conventional manner, to facilitate both shipping and storage of the bath aid 2. As such teaching is well known in the art, a further detail discussion concerning the same is not provided.

Since certain changes may be made in the above described bath aid, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, we claim:

1. A bath aid for use with a bathtub, the bath aid comprising:

an elongate body having a top portion and a remote, spaced apart bottom portion and having a continuous first surface, extending between the top portion and the bottom portion of the bath aid, for accommodating a back of a user during use;

the bath aid defining a cavity, on a second opposed surface thereof, for accommodating at least a water spout of a bathtub during use;

the top portion of the bath aid having an attachment device for releasably attaching the top portion of the bath aid to a desired surface and the bottom portion of the bath aid having a securing device, located remote from the top portion, for releasably engaging the bottom portion of the bath aid to a base surface of the bathtub such that the bottom portion of the bath aid contacts and rests against the base surface of the bathtub within the bathtub, during use, but the bottom portion is space from an adjacent end wall of the bathtub, and the bath aid is supported at a desired angle of inclination relative to the base surface of the bathtub.

2. The bath aid according to claim 1, wherein the attachment device is carried along the top edge of the bath aid for engaging with a desired surface and securing the bath aid in position.

3. The bath aid according to claim 2, wherein the attachment device comprises a plurality of suction cups and each one of the plurality of suction cups is adjustable along the top edge of the bath aid.

4. The bath aid according to claim 3, wherein each one of the plurality of suction cups is supported along the top edge of the bath aid via a slot to provide adjustment of each suction cup relative to the bath aid.

5. The bath aid according to claim 2, wherein the securing device comprises an elongate strip of a slip resistant material to facilitate secure positioning of the bath aid on a base surface of a bathtub, once a user sits upon the slip resistant material, to prevent the bath aid from being moved from a desired position once installed in the bath tub.

6. The bath aid according to claim 5, wherein the elongate strip of a slip resistant material includes a remote free end which, during use, rests on the base surface of the bathtub and facilitates a user's entry into and exit from the bathtub.

7. The bath aid according to claim 2, wherein the securing device comprises at least one suction cup supported by the bottom portion of the bath aid for engaging with the base surface of the bathtub and locating the bath aid in position.

8. The bath aid according to claim 2, wherein the securing device is carried along a bottom edge of the bath aid for engaging with the base surface of the bathtub and the bath aid has a constant width from the top portion to the bottom portion.

9. The bath aid according to claim 1, wherein at least one spacer is provided on the second opposed surface of the bath aid and the at least one spacer extends normal to the second opposed surface of the bath aid is located to maintain a spacing of an intermediate portion of a rear surface of the bath aid from an adjacent end wall of the bathtub, during use of the bath aid.

10. The bath aid according to claim 1, wherein the first surface of the bath aid is contoured for accommodating a back of a user; and the body is manufactured from separate top and bottom sections and the top and bottom sections are partially overlapped and releasably secured to one another to allow limited relative movement between the top and bottom sections and facilitate adjustment of the longitudinal length of the bath aid.

11. The bath aid according to claim 1, wherein a top portion of the bath aid supports a short leg which extends at an angle of between 60° and 90° relative to a remainder of the bath aid and a free end of the short leg carries the attachment device for releasably attaching the bath aid to the desired surface.

12. The bath aid according to claim 11, wherein the short leg has a length of between about 2 inches to about 6.

13. The bath aid according to claim 11, wherein the top portion of the elongate body and the short leg at least partially defined a cavity for accommodating at least a water spout of a bathtub.

14. The bath aid according to claim 13, wherein a pair of opposed side walls, which extend along a length of the elongate body from adjacent the top portion to adjacent the bottom portion further define, with the elongate body and the short leg, the cavity.

15. The bath aid according to claim 1, wherein the bath aid is made from one of a plastic material and a fiberglass material.

16. The bath aid according to claim 1, wherein the bath aid includes at least one reinforcement rib which is provided on the second opposed surface of the bath aid to provide structural reinforcement to the bath aid.

17. The bath aid according to claim 1, wherein the bath aid has a longitudinal length of between about 2 feet to about 4 feet and a transverse width of between about 10 inches to about 24 inches.

18. The bath aid according to claim 1, wherein the front surface of the bath aid has a curved profile for accommodating a back of a user during use; and and at least one spacer is provided on the rear surface of the second opposed surface of the bath aid, the at least one spacer extends normal to the second opposed surface of the bath aid, and the a least one spacer has an adjustable length to facilitate spacing an intermediate portion of the second opposed surface of the bath aid from an adjacent end wall of the bathtub during use.

19. A bath aid for use with a bathtub, the bath aid comprising:

a unitary elongate body having a top portion and a remote, spaced apart bottom portion and having a continuous first surface, extending between the top portion and the bottom portion of the bath aid, for accommodating a back of a user during use;

the bath aid defining a cavity, on a second opposed surface thereof, for accommodating at least a water spout of a bathtub during use; and the top portion of the bath aid having an attachment device for releasably attaching the top portion of the bath aid to a desired bathtub surface and the bottom portion of the bath aid having a securing device, located remote from the top portion, for releasably engaging the bottom portion of the bath aid to a base surface of the bathtub such that only the bottom portion of the bath aid is located within the bathtub and contacts and rests against the base surface of the bathtub within the bathtub, during use, but the bottom portion is space from an adjacent end wall of the bathtub, and the bath aid is supported at a desired angle of inclination relative to the base surface of the bathtub.

20. A method of using a bath aid within a bathtub to cover at least a water spout of a bathtub, the bath aid comprising a unitary elongate body having a top portion and a remote, spaced apart bottom portion and having a continuous first surface, extending between the top portion and the bottom portion of the bath aid, for accommodating a back of a user during use; the bath aid defining a cavity, on a second opposed surface thereof, for accommodating at least a water spout of a bathtub during use; and the top portion of the bath aid having an attachment device for releasably attaching the top portion of the bath aid to a desired bathtub surface and the bottom portion of the bath aid having a securing device, located remote from the top portion, for releasably engaging the bottom portion of the bath aid to a base surface of the bathtub such that only the bottom portion of the bath aid is located within the bathtub and contacts and rests against the base surface of the bathtub within the bathtub, during use, but the bottom portion is space from an adjacent end wall of the bathtub, and the bath aid is supported at a desired angle of inclination relative to the base surface of the bathtub, the method comprising the steps of:

engaging the attachment device with a desired bathtub surface;

engaging the securing with a bottom surface of the bathtub located within the bathtub such that only the bottom portion of the bath aid contacts and rests against the base surface of the bathtub; and spacing the bottom portion from an adjacent end wall of the bathtub such that the bath aid is supported at a desired angle of inclination relative to the base surface of the bathtub.

* * * * *